US007402941B2

(12) United States Patent
Shibata et al.

(10) Patent No.: US 7,402,941 B2
(45) Date of Patent: Jul. 22, 2008

(54) SPARK PLUG

(75) Inventors: Tsutomu Shibata, Owariasahi (JP); Toshitaka Honda, Iwakura (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 212 days.

(21) Appl. No.: 11/318,469

(22) Filed: Dec. 28, 2005

(65) Prior Publication Data

US 2006/0158081 A1 Jul. 20, 2006

(30) Foreign Application Priority Data

Dec. 28, 2004 (JP) ..... P. 2004-381502

(51) Int. Cl.
*H01T 13/20* (2006.01)

(52) U.S. Cl. ..... 313/145; 313/119; 313/144

(58) Field of Classification Search ..... 313/118–145; 123/169 R, 169 EL, 32, 41, 310
See application file for complete search history.

(56) References Cited

U.S. PATENT DOCUMENTS 2,248,415 A * 7/1941 Schwartzwalder et al. .. 174/152 S
2,321,840 A * 6/1943 McDougal ..... 174/152 S
2,615,441 A * 10/1952 Bychinsky ..... 174/152 S
2,798,980 A * 7/1957 Beardslee, Jr. ..... 313/136
3,538,021 A * 11/1970 Achey ..... 252/506
5,008,584 A * 4/1991 Atsumi et al. ..... 313/136
6,137,211 A * 10/2000 Sugimoto et al. ..... 313/145
6,160,342 A * 12/2000 Nishikawa et al. ..... 313/141
6,188,166 B1 * 2/2001 Nishikawa et al. ..... 313/141
6,191,525 B1 * 2/2001 Tanaka et al. ..... 313/141
6,334,800 B1 * 1/2002 Nishikawa et al. ..... 445/7
6,407,487 B1 * 6/2002 Sugimoto ..... 313/141
6,566,792 B2 * 5/2003 Nishikawa ..... 313/118
2002/0041136 A1 * 4/2002 Nishikawa ..... 313/118
2002/0041138 A1 * 4/2002 Nishikawa ..... 313/143

* cited by examiner

*Primary Examiner*—Mariceli Santiago
*Assistant Examiner*—Jose M Diaz
(74) *Attorney, Agent, or Firm*—Sughrue Mion, PLLC

(57) ABSTRACT

A spark plug including a cylindrical insulator having an axial hole extending in an axial direction; a center electrode held in the axial hole on a leading end side; a connecting terminal held in the axial hole on a trailing end side; and a sealing layer provided in the axial hole and including a glass sealing material containing a glass component and a metallic component, the sealing layer including a first sealing layer containing a first glass sealing material and a second sealing layer containing a second glass sealing material laminated in an axial direction of the axial hole, the first sealing layer contacting the center electrode, and the second sealing layer contacting the connecting terminal, wherein the second glass sealing material has a fluidity higher than that of the first glass sealing material at a temperature higher than a softening point of a glass component in the sealing layer.

9 Claims, 2 Drawing Sheets

SPARK PLUG

BACKGROUND OF THE INVENTION

1. Field of the Invention

The present invention relates to a spark plug for use in ignition of an internal combustion engine.

2. Description of the Related Art

A spark plug is conventionally used for ignition of an automobile engine. A spark plug generally includes: an insulator holding a center electrode on the leading end side of an axial hole and a connecting terminal on the trailing end side; a metal shell holding the insulator while enclosing the trunk portion thereof; and an earth electrode having one end thereof welded to the leading end of the metal shell and its other end opposed to the leading end of the center electrode to form a spark discharge gap.

The center electrode and the connecting terminal are electrically connected in the axial hole of the insulator through a conductive sealing member (or a sealing layer) (as disclosed, for example, in JP-A-2003-22886). Generally, the conductive sealing member is made from a mixture of a metal and glass to impart conductivity by dispersing metal powder into insulating glass. The center electrode and the connecting terminal are fixed in the axial hole by means of the sealing member.

In manufacturing the spark plug, the center electrode and the connecting terminal in the axial hole of the insulator are fixed in the following manner. First, the center electrode is inserted into the axial hole of the insulator from the trailing end side and is retained on a stepped portion in the axial hole, and the axial hole is filled from the trailing end side with the sealing member powder. Next, at a glass sealing step, the insulator is inserted into a heating furnace so that the sealing member is softened, and a connecting terminal is press-fitted from the trailing end side of the axial hole and sintered. Through these steps, the center electrode and the connecting terminal are fixed to seal the axial hole. This sealing step is called a "glass sealing step".

3. Problems to be Solved by the Invention

In order to realize a higher engine output, the valve employed for intake and exhaust is large-sized in recent years so as to considerably vibrate the engine. Vibration shocks thus applied to the spark plug which is mounted in the engine are also applied to the sealing member through the center electrode. However the sealing structure of a conventional spark plug may have insufficient shock resistance. To solve this problem, the shock resistance can be enhanced, for example, by increasing the content of the metallic component in the sealing member. However, the fluidity of the resulting sealing member is lowered such that it cannot flow sufficiently into the clearance between the inner circumference of the axial hole of the insulator and the outer circumference of the connecting terminal. This in turn causes another problem in that the connecting terminal is inadequately fixed to the insulator.

The present invention has been conceived in order to solve the aforementioned problem, and an object thereof is to provide a spark plug which can enhance the gas-tightness of an axial hole of an insulator and which can ensure adequate fixing of a connecting terminal and a center electrode in the axial hole.

SUMMARY OF THE INVENTION

In order to achieve the above-specified object, according to a first aspect (1), the present invention provides a spark plug comprising: a cylindrical insulator having an axial hole extending in an axial direction; a center electrode held in a leading end side of the axial hole of the insulator; a connecting terminal held in a trailing end side of the axial hole of the insulator; and a sealing layer provided in the axial hole and comprising a glass sealing material containing a glass component and a metallic component, the sealing layer including a first sealing layer and a second sealing layer laminated in the axial direction of the axial hole, the first sealing layer contacting the center electrode, and the second sealing layer contacting the connecting terminal, wherein glass sealing material contained in the second sealing layer has a fluidity higher than that of glass sealing material contained in the first sealing layer at a temperature higher than the softening point of the glass component constituting the sealing layer.

In accordance with a preferred embodiment (2) of the first aspect (1), the viscosity of the second sealing layer is lower than that of the first sealing layer at a temperature higher than the softening point of the glass component constituting the sealing layer.

In accordance with a preferred embodiment (3) of the first aspect (1), the softening point of the glass component constituting the second sealing layer is lower than that of the glass component constituting the first sealing layer.

In accordance with a preferred embodiment (4) of the first aspect (1), the first sealing layer contains more metallic component, on a weight basis, than the second sealing layer.

In accordance with a preferred embodiment (5) of the first aspect (1), the content of the metallic component in the first sealing layer is 53 wt. % or more and 70 wt. % or less, and the content of the metallic component in the second sealing layer is 30 wt. % or more and 52 wt. % or less.

In the spark plug of any of embodiments (1) to (5) above, in accordance with a preferred embodiment (6), the glass component of the sealing layer contains Si, B and an alkali metal comprising at least one of K and Na, and the content of one of Si and B in said sealing layer is larger than the content of any other glass component in said sealing layer, and the content of the other of Si and B in said sealing layer is not larger than the content of the one of Si and B and is larger than the content of any other glass component in the sealing layer, and the sealing layer satisfies either of the relationships: WB1<WB2, and WA1≦WA2; or WB1≦WB2, and WA1<WA2, wherein WB1 represents a content of B in the glass component of the first sealing layer in terms of $B_2O_3$, WB2 represents a content of B in the glass component of the second sealing layer in terms of $B_2O_3$, WA1 represents a content of A in the glass component of the first sealing layer in terms of $A_2O$, and WA2 represents a content of A in the glass component of the second sealing layer in terms of $A_2O$ in which A represents the alkali metal.

In the spark plug of embodiment (6) above, in accordance with a preferred embodiment (7), the content of B in the glass component of the sealing layer in terms of $B_2O_3$ is 22 wt. % or more and 45 wt. % or less.

In the spark plug of embodiment (6) above, in accordance with a preferred aspect (8), the content of the alkali metal A in the glass component of the sealing layer in terms of $A_2O$ is 4 wt. % or more and 15 wt. % or less.

In the spark plug of any of embodiments (6) to (8) above, in accordance with a preferred embodiment (9), the glass component of the first sealing layer contains: Si in an amount of 55 wt. % or more and 65 wt. % or less in terms of $SiO_2$; B in an amount of 22 wt. % or more and 35 wt. % or less in terms of $B_2O_3$; Ca in an amount of 0.2 wt. % or more and 2 wt. % or less in terms of CaO; Al in an amount of 2 wt. % or less in terms of $Al_2O_3$; and Na and K in total in an amount of 4 wt. % or more and 8 wt. % or less in terms of $Na_2O$ and $K_2O$, respectively, and the glass component of the second sealing layer contains: Si in an amount of 45 wt. % or more and 50 wt.

% or less in terms of $SiO_2$, B in an amount of 35 wt. % or more and 45 wt. % or less in terms of $B_2O_3$; and at least one of Na, K and Li in a total amount of 8 wt. % or more and 15 wt. % or less in terms of $Na_2O$, $K_2O$ and $Li_2O$, respectively.

In the spark plug of any of embodiments (6) to (9) above, in accordance with a preferred embodiment (10), the sealing layer further includes a third sealing layer interposed between the first sealing layer and the second sealing layer and containing a low-expansion filler having a smaller coefficient of thermal expansion than that of the glass component in the first sealing layer and that of the glass component of the second sealing layer.

In the spark plug according to the first aspect (1) of the invention, the glass sealing materials constituting the first sealing layer on the center electrode side and the second sealing layer on the connecting terminal side are adjusted to have different fluidities. Specifically, the glass sealing material (hereinafter also called the "second glass sealing material") constituting the second sealing layer has superior fluidity to that of the glass sealing material (hereinafter also called the "first glass sealing material") constituting the first sealing layer. It is more important to impart to the first sealing layer excellent shock resistance rather than retention of fluidity in the process of manufacturing the spark plug. In this manner, fixture of the center electrode and insulator may be ensured and maintained when employing the spark plug (that is, in operating the spark plug in an environment where the temperature is lower than the softening point of the glass sealing material). For the second sealing layer, on the other hand, it is more important to reliably fix the connecting terminal at the time of employing the spark plug. It is therefore important to use a glass sealing material having excellent fluidity so that the second glass sealing material may flow sufficiently into the clearance between the leading end portion of the connecting terminal and the insulator in the process of manufacturing the spark plug. By forming such sealing layers, the present invention provides a spark plug having enhanced gas-tightness of the axial hole of the insulator and in which the center electrode and the insulator are reliably fixed in the axial hole.

As one example for realizing the aforementioned spark plug, according to embodiment (2) of the invention, the second sealing layer may have a viscosity lower than that of the first sealing layer. The glass sealing step may be performed at about 850 to 950° C., and this temperature range is higher than the softening point of the glass component constituting the aforementioned sealing layers. As a result, both the first glass sealing material and the second glass sealing material are softened to become fluidic. When the center electrode is thus fixed in the insulator such that the first glass sealing material is harder than the second glass sealing material, the center electrode can be provided with excellent shock resistance. By using the second glass sealing material having a fluidity higher than that of the first glass sealing material, moreover, the invention can realize a spark plug having a connecting terminal which is reliably fixed to the insulator. This can be achieved by making the softening point of the glass component of the second sealing layer lower than that of the glass component of the first sealing layer, as in embodiment (3) above.

The viscosities of the first sealing layer and the second sealing layer containing the glass component and the metallic component may also be made different by making the contents of the metallic component different. When the first sealing layer contains the metallic component in an amount greater than that of the second sealing layer, as defined according to embodiment (4) of the invention, the viscosity of the second sealing layer can be made lower than that of the first sealing layer to thereby increase the fluidity of the second sealing layer. As a result, it is possible to increase the shock resistance of the first sealing layer and to form the second sealing layer between the leading end portion of the connecting terminal and the axial hole of the insulator to thereby reliably fix the center electrode and the connecting terminal in the axial hole.

When the content of the metallic component in the first sealing layer is 53 wt. % or more according to embodiment (5) of the invention, it is possible to more reliably increase the shock resistance of the first sealing layer. As a result, even if the engine vibrations are applied to the first sealing layer through the center electrode, it is possible to keep the center electrode fixed in the axial hole.

Since the content of the metallic component in the first sealing layer is 70 wt. % or less, it is possible to maintain sufficient fluidity of the first sealing layer at the time of manufacturing so as to form the first sealing layer between the trailing end portion of the center electrode and the axial hole of the insulator. If the content of the metallic component exceeds 70 wt. %, the difference in coefficient of thermal expansion between the center electrode and the first sealing layer becomes large to thereby lower the fixing force between the insulator of the spark plug, as formed through the glass sealing step at a high temperature, and the first sealing layer, to thereby lower the gas-tightness of the axial hole.

Since the content of the metallic component in the second sealing layer arranged on the connecting terminal side is 52 wt. % or less, the fluidity of the second sealing layer at the time of manufacturing is made higher. As such, the second glass sealing material can easily flow into the clearance between the leading end portion of the connecting terminal and the axial hole of the insulator to thereby easily form the second sealing layer. The second sealing layer especially flows in a rising direction between the leading end portion of the connecting terminal and the axial hole of the insulator, when the center electrode side is taken downward in the axial direction. The second sealing layer having a higher fluidity can flow more smoothly into the clearance.

Here, the surface of the leading end portion of the connecting terminal is often corrugated. These corrugations are formed to improve the fixing force of the leading end portion of the connecting terminal to the second sealing layer. In the case of using the sealing layer having a lower metal component and a higher fluidity, as in the invention, the inflow can be promoted by those corrugations to make the fixing force to the connecting terminal sufficient. Generally, the sealing layer having a lower metallic component content has a reduced fixture to the metallic connecting terminal, but sufficient fixing force can be obtained by the combined effect of the corrugations and the highly fluidic sealing layer.

Moreover, the sealing layer has a structure in which electrical conductivity is maintained by the metallic component diffusing into the insulating component. As the content of the metallic component in the second sealing layer is reduced, the conductivity may become lower. By setting the content of the metallic component in the second sealing layer to 30 wt. % or more, however, it is possible to maintain high conductivity of the second sealing.

According to embodiment (6) above, moreover, the glass component in the sealing layer may be a so-called "borosilicate glass", which contains one of Si and B in an amount greater than any other glass component in the sealing layer, and contains the other of Si and B in an amount not greater than the one of Si and B and in an amount greater than any other glass component in the sealing layer. Generally, the borosilicate glass has a low coefficient of thermal expansion and a high heat resistance. Therefore, the occurrence of separations or cracks between the sealing layer and the insulator can be reduced if a sealing layer which is influenced by heat generated as the engine runs is employed in the spark plug.

Moreover, when the content WB1 represents the content of B in the glass component of the first sealing layer in terms of $B_2O_3$, WB2 represents the content of B in the glass component of the second sealing layer in terms of $B_2O_3$, WA1 represents the content of A in the glass component of the first sealing layer in terms of $A_2O$ and WB2 represents the content of A in the glass component of the second sealing layer in terms of $A_2O$ in which A represents the alkali metal, the individual weights satisfy either of the relationships: WB1<WB2, and WA1≦WA2; or WB1≦WB2, and WA1<WA2, so that the softening point of the second sealing layer can be made lower than that of the first sealing layer. In short, by making the viscosity of the second sealing layer lower than that of the first sealing layer, the second sealing layer at the time of manufacturing has increased fluidity so as to reliably fix the connecting terminal in the axial hole.

The content of B in the glass component of the sealing layer in terms of $B_2O_3$ is preferably 22 wt. % or more and 45 wt. % or less according to embodiment (7) of the invention. When the content of B is less than 22 wt. %, the softening point of the glass component rises to make it difficult to soften the sealing layer at the glass sealing step, and an insufficient inserting force may be applied so as not to fully insert the connecting terminal into the axial hole of the insulator. If the inserting force at the time of inserting the connecting terminal is simply raised, the stress accompanying the press-fitting operation may break the insulator from the inside of the axial hole. If the B content exceeds 45 wt. %, on the other hand, the softening point of the glass component of the sealing layer is lowered to increase the thermal expansion coefficient. By the influence of heat generated as the engine runs, separations or cracks may occur between the sealing layer and the insulator to thereby make it difficult to maintain gas-tightness.

According to embodiment (8) of the invention, the content of the alkali metal A in the glass component of the sealing layer in terms of $A_2O$ is preferably 4 wt. % or more and 15 wt. % or less. The alkali metal A component is effective for lowering the softening point of the glass component of the sealing layer, and can hardly lower the softening point of the glass component of the sealing layer if present in an amount of less than 4 wt. %. If the content of A exceeds 15 wt. %, on the other hand, the softening point of the glass component of the sealing layer is lowered, but the thermal expansion coefficient increases. In that case, when heat is generated as the engine runs, separations or cracks may occur between the sealing layer and the insulator to thereby lower the gas-tightness.

By setting the glass component in the first sealing layer and the glass component in the second sealing layer individually at predetermined compositions, according to the invention, it is possible to make the gas-tightness of the axial hole of the insulator higher and the fixture between the center electrode and the connecting terminal in the axial hole more reliable. According to embodiment (9) of the invention, more specifically, the glass component in the first sealing layer contains: Si in an amount of 55 wt. % or more and 65 wt. % or less in terms of $SiO_2$; B in an amount of 22 wt. % or more and 35 wt. % or less in terms of $B_2O_3$; Ca in an amount of 0.2 wt. % or more and 2 wt. % or less in terms of CaO; Al in an amount of 2 wt. % or less in terms of $Al_2O_3$; and Na and K in a total amount of 4 wt. % or more and 8 wt. % or less in terms of $Na_2O$ and $K_2O$, respectively. Moreover, the glass component in the second sealing layer contains: Si in an amount of 45 wt. % or more and 50 wt. % or less in terms of $SiO_2$, B in an amount of 35 wt. % or more and 45 wt. % or less in terms of $B_2O_3$; and at least one of Na, K and Li in a total amount of 8 wt. % or more and 15 wt. % or less in terms of $Na_2O$, $K_2O$ and $Li_2O$, respectively.

The glass component in the sealing layer contains Si and B. From the relationship in the content of B between the first sealing layer and the second sealing layer, the Si content in terms of $SiO_2$ preferably is greater in the first sealing layer than in the second sealing layer. If the content of Si exceeds 65 wt. %, the softening point of the glass component of the sealing layer becomes high, and the connecting terminal may not be sufficiently inserted into the axial hole of the insulator at the glass sealing step. If the Si content is less than 45 wt. %, on the other hand, the thermal expansion coefficient becomes high. In that case, when heat is generated as the engine runs, separations or cracks may occur between the sealing layer and the insulator to thereby lower gas-tightness.

Ca is added, for example, to stabilize the resistance of a resistor, when the resistor is inserted between the first sealing layer and the second sealing layer, or to lower the softening point of the glass component of the sealing layer. If the content of Ca in terms of CaO is 0.2 wt. % or less, it may be difficult to stabilize the resistance at the time of inserting the resistor or to sufficiently lower the softening point of the glass component of the sealing layer. If the Ca content is more than 2 wt. %, on the other hand, the thermal expansion coefficient becomes high. In that case, when heat is generated as the engine runs, separations or cracks may occur between the sealing layer and the insulator to thereby lower gas-tightness.

Al is contained as an unavoidable impurity in the sealing layer. If the Al content in terms of $Al_2O_3$ exceeds 2 wt. %, the softening point of the glass component of the sealing layer becomes high, and the connecting terminal may not be sufficiently inserted into the axial hole of the insulator at the glass sealing step. The Al content is preferably closer to 0 wt. %.

Moreover, Li may also be present as the alkali metal A in addition to the aforementioned K and Na. If the content of the alkali metal A in the glass component of the first sealing layer in terms of $Al_2O_3$ is 8 wt. % or less, and if the content in the glass component of the second sealing layer is 8 wt. % or more, the content WA1 of the alkali metal A in the glass component of the first sealing layer can be more reliably set so as to be equal to or less than the content of WA2 in the glass component of the second sealing layer.

Moreover, the contents of Si and B in the sealing layer and the content of the alkali metal A may be adjusted either simultaneously or independently. In either case, it is effective to make the first sealing layer harder than the second sealing layer so as to reliably fix the center electrode and the connecting terminal in the axial hole of the insulator.

According to embodiment (10) of the invention, moreover, if a third sealing layer containing a low-expansion filler is interposed between the first sealing layer and the second sealing layer, a seal structure having excellent shock resistance and gas-tightness can be realized.

DESCRIPTION OF REFERENCE NUMERALS

Figure 1:
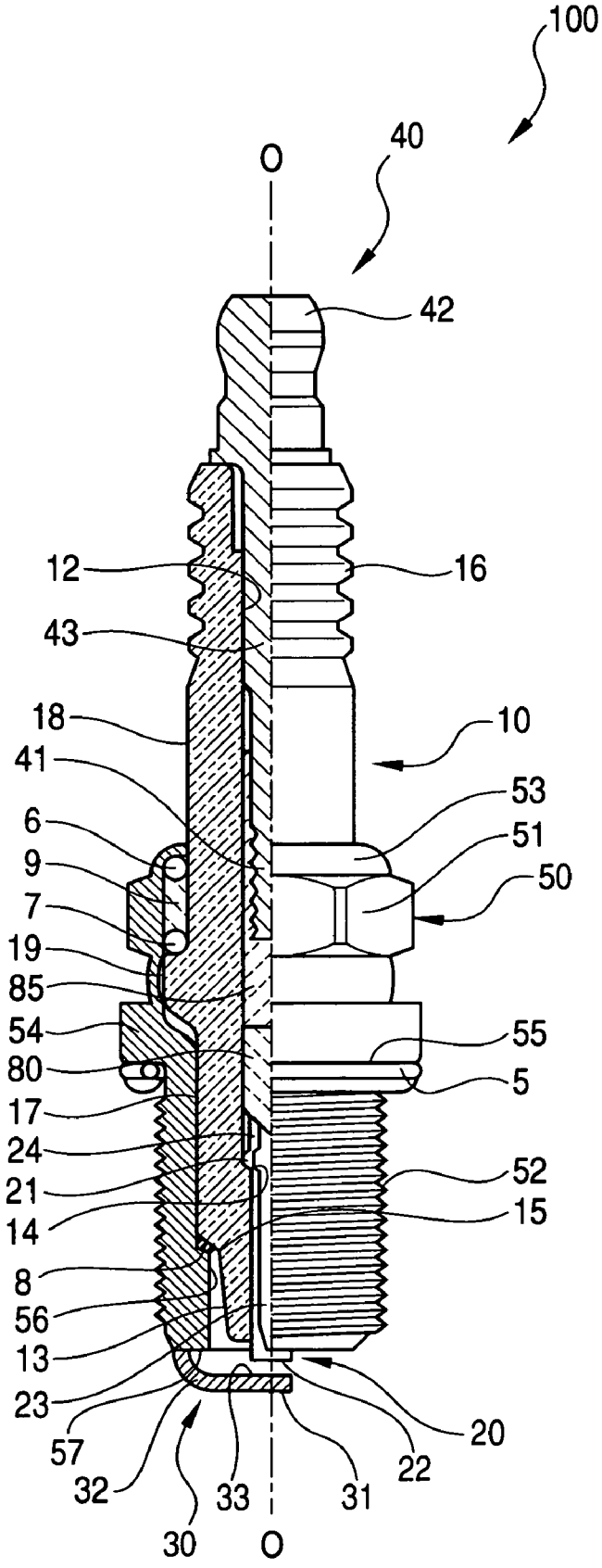
FIG. 1 is a partial sectional view of a spark plug 100.

Reference numerals used to identify various structural features in the drawings include the following.

| | |
|---|---|
| 10 | Insulator |
| 12 | Axial Hole |
| 20 | Center Electrode |
| 40 | Connecting Terminal |
| 80 | Sealing Member |
| 85 | Sealing Member |
| 100 | Spark Plug |

DETAILED DESCRIPTION OF THE INVENTION

One embodiment of a spark plug according to the invention will be described with reference to the accompanying drawings. However, the present invention should not be construed as being limited thereto. First of all, the structure of a spark plug 100 is described as one example of the spark plug according to the invention with reference to FIG. 1. FIG. 1 is a partial sectional view of the spark plug 100.

As shown in FIG. 1, the spark plug 100 is schematically constructed to include: an insulator 10; a metal shell 50 for holding the insulator 10; a center electrode 20 held in the axial hole 12 of the insulator 10; an earth electrode 30 having a leading end portion 31 opposed at its inner face 33 to the leading end face 22 of the center electrode 20; and a connecting terminal 40 disposed on the trailing end side of the insulator 10.

At first, the insulator 10 of the spark plug 100 is explained. The insulator 10 is a cylindrical insulating member, as well known in the art, and is formed by sintering alumina or the like to have the axial hole 12 in the direction of an axis 0. A flanged portion 19 having the largest diameter is formed substantially at the center in the axial direction O, and a trailing end side trunk portion 18 is formed on the trailing end side of the flanged portion 19. On the further trailing end side of the trailing end side of the trailing end side trunk portion 18, a corrugated portion 16 provides a creeping distance. On the leading end side of the flanged portion 19, a leading end side trunk portion 17 is formed, which has a smaller external diameter than that of the trailing end side trunk portion 18. On the leading end side of the leading end side trunk portion 17, a long stem 13 is formed, which has a smaller external diameter than that of the leading end side trunk portion 17. The long stem 13 is more radially reduced toward the leading end side and is exposed, when the spark plug 100 is assembled with a not-shown internal combustion engine, to the combustion chamber of the engine.

Next, the center electrode 20 is explained. This center electrode 20 is a rod-shaped electrode, in which a core 23 made from copper or its alloy for promoting heat transfer is buried in the central portion of an electrode base metal made from a nickel alloy of INCONEL (known under the trade name) 600 or 601 or the like. On the trailing end side of the center electrode 20, a flanged portion 21 is formed, which is retained on a stepped portion 14 formed in the axial hole 12 of the insulator 10. The center electrode 20 is so held in the axial hole 12 corresponding to the portion having the long stem 13 so as to protrude from the leading end face of the insulator 10. Moreover, the trailing end portion 24 of the center electrode 20 protrudes to the back side of the flanged portion 21.

The center electrode 20 is electrically connected with the connecting terminal 40 held on the trailing end side of the axial hole 12 through a sealing member 80 and a sealing member 85, which are disposed in the axial hole 12. The connecting terminal 40 is provided with a trunk portion 43 having a diameter substantially equal to the internal diameter of the axial hole 12 of the insulator 10, and a leading end portion 41 disposed on the leading end side of the trunk portion 43 and having a small diameter. The trunk portion 43 and the leading end portion 41 are inserted into the axial hole 12. The leading end portion 41 is corrugated on its outer circumference to more securely fasten the sealing member 85 and is generally knurled or threaded. The connecting terminal 40 is exposed at its trailing end portion 42 from the trailing end of the insulator 10 and is connected with a (not-shown) high-voltage cable through a (not-shown) plug cap so that it is supplied with a high voltage. Here, the sealing member 80 corresponds to the "first sealing layer" of the invention, and the sealing member 85 corresponds to the "second sealing layer" of the invention. These sealing members 80 and 85 will be described hereinafter.

Next, the metal shell 50 is explained. This metal shell 50 holds the insulator 10 and fixes the spark plug 100 in a not-shown internal combustion engine. The metal shell 50 holds the insulator 10 such that it encloses the flanged portion 19, the leading end side trunk portion 17 and the long stem 13 from the trailing end side trunk portion 18 near the flanged portion 19 of the insulator 10. The metal shell 50 is made from low-carbon steel and is provided with a fixture engaging portion 51 to be fitted by a not-shown spark plug wrench, and a threaded portion 52 to be screwed in the engine head disposed in the upper portion of a not-shown internal combustion engine. The metal shell 50 is further provided with an additionally fastened portion 53 on the trailing end side of the fixture engaging portion 51. When the additionally fastened portion 53 is additionally fastened, a stepped portion 15 of the insulator 10 between the leading end side trunk portion 17 and the long stem 13 is supported through a leaf packing 8 on a stepped portion 56 formed on the inner circumference of the metal shell 50, so that the metal shell 50 and the insulator 10 are integrated. In order to make the sealing complete by the additional fastening, annular ring members 6 and 7 are sandwiched between the inner circumference of the metal shell 50 near the additionally fastened portion 53 and the outer circumference of the trailing end side trunk portion 18 near the flanged portion 19 of the insulator 10, and the clearance between the ring members 6 and 7 is filled with talc powder 9. Moreover, a flanged portion 54 is formed at the central portion of the metal shell 50, and a gasket 5 is fitted on the seat face of the flanged portion 54 near the trailing end portion side (as located in the upper portion of FIG. 1) of the threaded portion 52.

Next, the earth electrode 30 is explained. This earth electrode 30 is made from a metal having a high corrosion resistance as exemplified by an Ni alloy such as INCONEL (known under the trade name) 600 or 601 or the like. The earth electrode 30 presents a bent square bar contour having a substantially rectangular transverse section normal to its own longitudinal direction. The earth electrode 30 is joined at its base portion 32 on the square bar shaped base end side to a leading end face 57 of the metal shell 50 by a resistance welding operation. On the other hand, the leading end portion 31 on the opposite side of the base portion 32 of the earth electrode 30 is bent on its inner face 33 so as to confront the leading end face 22 of the center electrode 20 to thereby form a spark discharge gap therebetween.

Here, the sealing member 80 in contact with the center electrode 20 and the sealing member 85 in contact with the connecting terminal 40 are sintered in the axial hole 12 so as to be laminated in the axial direction O. These sealing members 80 and 85 are fixed between the center electrode 20 and the connecting terminal 40 and in the axial hole 12 to thereby fix and impart electrical conductivity to the two sealing members 80 and 85. The sealing members 80 and 85 of this embodiment are made from glass seals containing mixtures of metallic components and glass components of differing composition. Based on the results of evaluation tests described below, the viscosity of the sealing member 80 is set so as to be higher than that of the sealing member 85 at a temperature higher than the softening point of the glass component contained in the sealing member 80 and the softening point of the glass component contained in the sealing member 85. The viscosities of the sealing members 80 and 85 are so determined in this embodiment that the content of the metallic component in the sealing member 80 is 53 wt. % or more and 70 wt. % or less, and the content of the metallic component in the sealing member 85 is 30 wt. % or more and 52 wt. % or less. In short, the sealing member 80 arranged on the side of the center electrode 20 has a higher metallic content and a higher hardness than those of the sealing member 85 arranged on the side of the connecting terminal 40. The metallic components of the sealing members 80 and 85 are desirably exemplified by metallic powder composed mainly of one kind or two kinds of metallic components such as copper or iron, or brass powder, for example.

In this embodiment, moreover, the softening point of the glass component in the sealing member 85 is lower than that of the glass component in the sealing member 80. In the temperature range for the glass sealing step, generally speaking, the glass component having a lower softening point has a higher fluidity so that the fluidity of the glass component in the sealing member 85 arranged on the side of the connecting terminal 40 is higher than that of the glass component in the sealing member 80 arranged on the side of the center electrode 20.

The glass components contained in the sealing members 80 and 85 are made from a material containing Si, B and an alkali metal A comprising at least one of K and Na. Of the glass components, the content of one of Si and B in the sealing layer is preferably larger than the content of any other glass component in the sealing layer, and the content of the other of Si and B in the sealing layer is not larger than the content of the one of Si and B and is larger than content of any other glass component in the sealing layer. Moreover, the components contained in the sealing members 80 and 85 preferably satisfy either of WB1<WB2 and WA1≦WA2, or WB1≦WB2 and WA1<WA2, where the B content in the glass component of the sealing member 80 in terms of $B_2O_3$ is given as WB1, the B content in the glass component of the sealing member 85 in terms of $B_2O_3$ is given as WB2, the A content in the glass component of the sealing member 80 in terms of $A_2O$ is given as WA1, and the A content in the glass component of the sealing member 85 in terms of $A_2O$ is given as WA2.

Moreover, the B content is preferably 22 wt. % or more and 45 wt. % or less in terms of $B_2O_3$ in the glass components of the sealing members 80 and 85, and the A content is 4 wt. % or more and 15 wt. % or less in terms of $A_2O$. In short, the glass components in the sealing members 80 and 85 are desirably exemplified by a glass powder composed mainly of an oxide of the borosilicate group containing Si and B as major components, such as borosilicate glass.

In order to fix the center electrode 20 and the connecting terminal 40 in the axial hole 12 so as to be electrically connected with one another, as described hereinbefore, the sealing members 80 and 85 desirably have satisfactory performance in such aspects as gas tightness, shock resistance and conductivity. In order to acquire these characteristics, according to this embodiment, the composition of the glass components in the sealing member 80 in contact with the center electrode 20 is specified on the basis of the results of evaluation tests described below as follows.

Composition (1):

Si: a Si content in terms of $SiO_2$ of 55 wt. % or more and 65 wt. % or less;

B: a B content in terms of $B_2O_3$ of 22 wt. % or more and 35 wt. % or less;

Ca: a Ca content in terms of CaO of 0.2 wt. % or more and 2 wt. % or less;

Al: an Al content in terms of $Al_2O_3$ of 0.2 wt. % or less; and

Na, K: a total Na and K content in terms of $Na_2O$ and $K_2O$, respectively, of 4 wt. % or more and 8 wt. % or less.

On the other hand, the ranges of the following compositions (2) to (4) can be enumerated as those which can make the softening point of the glass components in the sealing member 85 lower than that of the glass components in the sealing member 80.

Composition (2):

Si: a Si content in terms of $SiO_2$ of 45 wt. % or more and 50 wt. % or less;

B: a B content in terms of $B_2O_3$ of 35 wt. % or more and 45 wt. % or less;

Al: an Al content in terms of $Al_2O_3$ of 2 wt. % or less; and

Alkali Metal A (e.g., K, Na or Li): an alkali metal content in terms of $A_2O$ of 8 wt. % or less and 15 wt. % or less.

Composition (3):

Si: a Si content in terms of $SiO_2$ of 55 wt. % or more and 65 wt. % or less;

B: a B content in terms of $B_2O_3$ of 22 wt. % or more and 35 wt. % or less;

Al: an Al content in terms of $Al_2O_3$ of 2 wt. % or less; and

Alkali Metal A (e.g., K, Na or Li): An alkali metal content in terms of $A_2O$ of 8 wt. % or less and 15 wt. % or less.

Composition (4):

Si: a Si content in terms of $SiO_2$ of 45 wt. % or more and 50 wt. % or less;

B: a B content in terms of $B_2O_3$ of 35 wt. % or more and 45 wt. % or less;

Ca: a Ca content in terms of CaO of 0.2 wt. % or more and 2 wt. % or less;

Al: an Al content in terms of $Al_2O_3$ of 0.2 wt. % or less; and

Na, K: a total Na and K content in terms of $Na_2O$ and $K_2O$, respectively, of 4 wt. % or more and 8 wt. % or less.

The composition (4) differs in the individual contents of Si and B from that of composition (1). The composition (3) also differs in the content of alkali metal A from that of composition (1). The composition (2) differs individually in the contents of Si and B and in the content of the alkali metal A from those of composition (1). The effect of lowering the softening point is attained if the content of B is increased from the range specified in composition (1). The effect of lowering the softening point is also attained if the content of the alkali metal A is increased from the range specified in composition (1). The compositions (1) to (4) thus far described specify the contents of the individual components on the basis of the results of evaluation tests described below so as to attain the effect of lowering the softening point from that of the composition (1).

Figure 2:
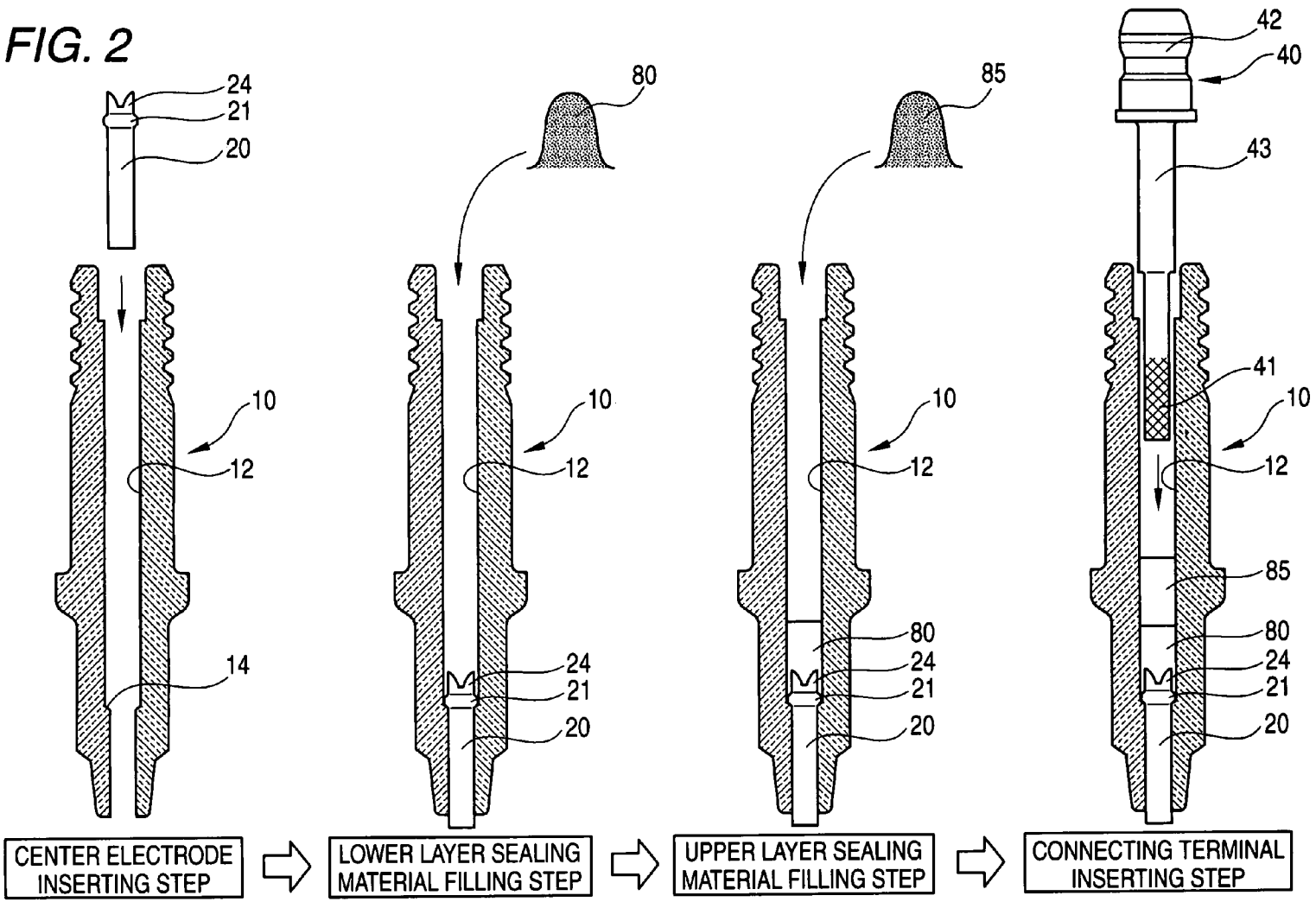
FIG. 2 is a diagram schematically showing the steps of manufacturing the spark plug 100.

The spark plug 100 thus constructed is manufactured by a method including the steps shown in FIG. 2, for example. FIG. 2 shows the steps for manufacturing the spark plug 100. As shown in FIG. 2, the center electrode 20 is inserted (at a center electrode inserting step) at first from its trailing end side into the axial hole 12 of the insulator 10. The center electrode 20 is positioned such that its flanged portion 21 is retained on the stepped portion 14 formed in the axial hole 12 of the insulator 10.

Next, the axial hole 12 of the insulator 10 is filled (at a lower sealing member filling step) with the powdery sealing member 80, which has been prepared by mixing powder of a glass component and powder of a metallic component. After the sealing member 80 is filled, the sealing member 80 is pushed from the trailing end side of the axial hole 12 with a not-shown press pin. Next, the powdery sealing member 85, which has been prepared like the sealing member 80 by mixing powder of a glass component and powder of a metallic component at a mixing ratio different from that of the sealing member 80, is filled (at an upper sealing member filling step), and is laid over the sealing member 80, (where the center electrode 20 is located on the lower side in the axial direction of the axial hole 12). This sealing member 85 is pushed again from the trailing end side of the axial hole 12 with the not-shown press pin. By these two pushing operations of the sealing members, the filled densities of the individual sealing members are increased, and the flanged portion 21 of the center electrode 20 is brought into close contact with the stepped portion 14 of the axial hole 12 by the pushing force transmitted through the individual sealing members.

The connecting terminal 40 is inserted from the trailing end side of the insulator 10 thus having the sealing members 80 and 85 filled. After this, the insulator 10 having the connecting terminal 40 inserted is introduced into a not-shown heating furnace so that it is heated to a predetermined temperature. Then, the connecting terminal 40 is pushed (at a connecting terminal inserting step) from the trailing end side of the insulator 10. By way of this step, the sealing members 80 and 85 are condensed/sintered so that the insulator 10 is completed as an integral part, which has the center electrode 20 and the connecting terminal 40 fixed by the sealing member 80 and the sealing member 85. These steps are generally called the "glass sealing step".

Here, the insulator 10 to be used may be prepared by applying glaze to its outer surface and by sintering to form a glazed layer in advance. However, a so-called "simultaneous sintering" may also be performed by applying/drying the glaze before the glass sealing step, and by heating it at the glass sealing step to thereby form the sealing layer and the glazed layer.

In the spark plug 100 thus manufactured, the content of the metallic component in the sealing member 85 is lower than that of the sealing member 80. Consequently, the spark plug 100 can have excellent fluidity at the glass sealing step to thereby firmly fix the connecting terminal. On the other hand, the sealing member 80 contains more metal component than the sealing member 85 so that it has excellent shock resistance. When the spark plug 100 is attached for use to a not-shown engine, the shocks accompanying engine vibrations are applied through the center electrode 20 to the sealing member 80. Excellent shock resistance of the sealing member 80 is effective for preventing the center electrode 20 or the like from being loosened by those shocks.

Moreover, the sealing member 80 containing a metallic component having a larger coefficient of thermal expansion than that of the glass component and in higher content than the sealing member 85 is fixed with excellent force to the center electrode 20 having a smoother surface than that of the leading end portion 41 of the connecting terminal 40. This is because the difference between the thermal expansion coefficients of the center electrode 20 and the sealing member 80 is such that a large difference in coefficient does not occur between the center electrode 20 and the sealing member 80 at the glass sealing step carried out at high temperature to thereby enhance the drape. As a result, there is hardly any clearance between the center electrode 20 and the sealing member 80, when the spark plug is attached for use to an engine, so that the axial hole 12 can be kept gas-tight.

On the other hand, the sealing member 85 having a lower metallic component content than that of the sealing member 80 has a higher glass component content. The leading end portion 41 of the connecting terminal 40 is knurled or threaded into a corrugated shape, which is effective when the sealing member 85 containing a higher glass component than that of the sealing member 80 so as to have a higher fluidity flows into the clearance between the outer circumference of the leading end portion 41 and the inner circumference of the axial hole 12. Moreover, the corrugations strengthen the fixture between the sealing member 85 and the leading end portion 41 so that the connecting terminal 40 can be sufficiently retained by the sealing member 85 even when shocked from the outside. Moreover, the sealing member 85 flows upward in the clearance, which is located in the axial direction O with the center electrode 20 being on the lower side. The sealing member 85 having greater fluidity than that of the sealing member 80 is directed to flow into the clearance by the corrugations of the leading end portion 41 of the connecting terminal 40. The effect is that the sealing member 85 can smoothly flow into that clearance.

Moreover, the glass components in the sealing members 80 and 85 are high in so-called "drape" with the insulator 10 made from ceramics so that the sealing member 80 fixed on the trailing end portion 24 of the center electrode 20 can be fixed on the axial hole 12 to thereby integrally fix the center electrode 20 and the insulator 10. Likewise, the sealing member 85 fixed on the leading end portion 41 of the connecting terminal 40 can be fixed in the axial hole 12, to thereby integrally fix the connecting terminal 40 and the insulator 10.

The following evaluation tests were made to confirm the effects of the invention, obtained by forming two sealing members fitted in an axial hole 12 between the center electrode 20 and the center electrode 20, by making sealing members of different composition, and by adjusting the content of the metallic component of the sealing member 80 on the side of the center electrode 20 so as to be higher than that of the sealing member 85 on the side of the connecting terminal 40.

EXAMPLE 1

In these evaluation tests, twenty kinds of combinations were prepared for two kinds of sealing members having different glass component and metallic compositions, and twenty kinds of spark plugs manufactured by the aforementioned manufacturing method were individually tested for gas-tightness, shock resistance and conductivity.

In the first to twelfth samples, the sealing members on both the center electrode side and the connecting terminal side contained a borosilicate glass as the glass component.

In the first to seventeenth samples, both the center electrode side sealing member and the connecting terminal side sealing member contained a borosilicate glass X falling within the range of composition (1).

Composition of Borosilicate Glass X:

Si: Si content in terms of $SiO_2$ of 62 wt. %;

B: B content in terms of $B_2O_3$ of 32 wt. %;

Ca: Ca content in terms of CaO of 0.5 wt. %;

Al: Al content in terms of $Al_2O_3$ of 1.0 wt. %; and

Na, K: a total Na and K content in terms of $Na_2O$ and $K_2O$, respectively, of 4.5 wt. %.

In the eighteenth and twentieth samples, the center electrode side sealing member contained the borosilicate glass X, and the connecting terminal side contained a borosilicate glass Y falling within the range of composition (4).

Composition of Borosilicate Glass Y:

Si: Si content in terms of $SiO_2$ of 45 wt. %;

B: B content in terms of $B_2O_3$ of 40 wt. %;

Ca: Ca content in terms of CaO of 0.5 wt. %;

Al: Al content in terms $Al_2O_3$ of 1.0 wt. %; and

Na, K: total Na and K content in terms of $Na_2O$ and $K_2O$, respectively, of 4.5 wt. %.

In the nineteenth sample, moreover, both the center electrode side sealing member and the connecting terminal side sealing member contained the borosilicate glass Y as the glass component.

On the other hand, the metallic component used in these samples was Cu-10Zn alloy powders (average particle size: 10 μm, maximum particle size: 50 μm). In the first sample, moreover, the content of the metallic component of the center electrode side sealing member was 75 wt. %, and the content of the metallic component of the connecting terminal side sealing member was 30 wt. %. Likewise, in the second to twentieth samples, the contents of the metallic component of the center electrode sealing member were 70, 70, 70, 70, 70, 58, 58, 58, 58, 58, 55, 55, 53, 37, 37, 37, 58, 58, and 58 (wt. %), respectively, and the contents of the metallic component of the connecting terminal sealing member were 70, 58, 52, 37, 30, 58, 52, 37, 30, 25, 52, 30, 37, 58, 37, 30, 58, 58 and 52 (wt. %). The twenty-first sample will be described hereinafter.

In the evaluation tests of gas-tightness for the individual samples, the trailing end side of the insulator having the fixed connecting terminal was dipped in an alcohol liquid at room temperature (e.g., 20° C.), and the leading end portion of the insulator including the axial hole holding the center electrode was sealed and fed with an air pressure of 1.5 MPa. In this state, it was confirmed whether or not an air leak occurred in the clearance between the connecting terminal and the axial hole. If an air leak was defected, the sample was graded "X", because the seal of the axial hole by the sealing members was insufficient. If no air leak was detected, the sample was graded "o", because the seal was sufficient.

The evaluation test of shock resistance on the individual samples was carried out based on the testing method described in JIS B8031 [1995], to determine whether or not the center electrode and the connecting terminal were loosened with respect to the axial hole. Particularly, the samples were subjected to shocks applied at a rate of 400 times per minute for ten minutes, and then the center electrode and the connecting terminal were individually touched while holding the insulator in place. If looseness was detected at the center electrode, the sample was graded "X". Namely, because the sealing members did not sufficiently flow into the clearance between the trailing end portion of the center electrode and the axial hole 12, the fixture of the center electrode could not kept. The evaluation was similar in the case that looseness could be confirmed at the connecting terminal. If looseness was not detected in either of the sealing members, the sample was graded "o". This is because the fluidity of the sealing members while heating was retained, permitting the sealing members to sufficiently flow into the clearance between the individual members. The individual members were thus integrated by the sealing member fixtures.

Moreover, the electrical resistance R between the center electrode and the connecting terminal was measured in the respective samples. The sample was graded "X" when the resistance R exceeded 100 mΩ (high resistance of the interposed sealing members). The sample was graded "o" when the electric resistance R was 100 mΩ or less (low resistance of the interposed sealing members).

TABLE 1

| | Center Electrode Side Sealing Member | | | |
|---|---|---|---|---|
| | Glass Component | | Metal Component | |
| Sample | Component | wt. % | Component | wt. % |
| 1 | BS Glass X | 25 | Cu—Zn | 75 |
| 2 | BS Glass X | 30 | Cu—Zn | 70 |
| 3 | BS Glass X | 30 | Cu—Zn | 70 |
| 4 | BS Glass X | 30 | Cu—Zn | 70 |
| 5 | BS Glass X | 30 | Cu—Zn | 70 |
| 6 | BS Glass X | 30 | Cu—Zn | 70 |
| 7 | BS Glass X | 42 | Cu—Zn | 58 |
| 8 | BS Glass X | 42 | Cu—Zn | 58 |
| 9 | BS Glass X | 42 | Cu—Zn | 58 |
| 10 | BS Glass X | 42 | Cu—Zn | 58 |
| 11 | BS Glass X | 42 | Cu—Zn | 58 |
| 12 | BS Glass X | 45 | Cu—Zn | 55 |
| 13 | BS Glass X | 45 | Cu—Zn | 55 |
| 14 | BS Glass X | 47 | Cu—Zn | 53 |
| 15 | BS Glass X | 63 | Cu—Zn | 37 |
| 16 | BS Glass X | 63 | Cu—Zn | 37 |
| 17 | BS Glass X | 63 | Cu—Zn | 37 |
| 18 | BS Glass X | 42 | Cu—Zn | 58 |
| 19 | BS Glass Y | 42 | Cu—Zn | 58 |
| 20 | BS Glass X | 42 | Cu—Zn | 58 |
| 21 | BS Glass X | 42 | Cu—Zn | 58 |

| | Center Electrode Side Sealing Member | | | |
|---|---|---|---|---|
| | Glass Component | | Metal Component | |
| Sample | Component | wt. % | Component | wt. % |
| 1 | BS Glass X | 70 | Cu—Zn | 30 |
| 2 | BS Glass X | 30 | Cu—Zn | 70 |
| 3 | BS Glass X | 42 | Cu—Zn | 58 |
| 4 | BS Glass X | 48 | Cu—Zn | 52 |
| 5 | BS Glass X | 63 | Cu—Zn | 37 |
| 6 | BS Glass X | 70 | Cu—Zn | 30 |
| 7 | BS Glass X | 42 | Cu—Zn | 58 |
| 8 | BS Glass X | 48 | Cu—Zn | 52 |
| 9 | BS Glass X | 63 | Cu—Zn | 37 |
| 10 | BS Glass X | 70 | Cu—Zn | 30 |
| 11 | BS Glass X | 75 | Cu—Zn | 25 |
| 12 | BS Glass X | 48 | Cu—Zn | 52 |
| 13 | BS Glass X | 70 | Cu—Zn | 30 |
| 14 | BS Glass X | 63 | Cu—Zn | 37 |
| 15 | BS Glass X | 42 | Cu—Zn | 58 |
| 16 | BS Glass X | 63 | Cu—Zn | 37 |
| 17 | BS Glass X | 70 | Cu—Zn | 30 |
| 18 | BS Glass Y | 42 | Cu—Zn | 58 |
| 19 | BS Glass Y | 42 | Cu—Zn | 58 |
| 20 | BS Glass Y | 48 | Cu—Zn | 52 |
| 21 | BS Glass X | 63 | Cu—Zn | 37 |

| | | | Shock Resistance | |
|---|---|---|---|---|
| Sample | Third Layer | Gas-Tightness | Loose Center Electrode | Loose Connecting Terminal |
| 1 | — | X | ○ | ○ |
| 2 | — | ○ | ○ | X |
| 3 | — | ○ | ○ | X |
| 4 | — | ○ | ○ | ○ |
| 5 | — | ○ | ○ | ○ |

-continued

| Sample | Third Layer | Gas-Tightness | Shock Resistance: Loose Center Electrode | Shock Resistance: Loose Connecting Terminal |
|---|---|---|---|---|
| 6 | — | ○ | ○ | ○ |
| 7 | — | ○ | ○ | X |
| 8 | — | ○ | ○ | ○ |
| 9 | — | ○ | ○ | ○ |
| 10 | — | ○ | ○ | ○ |
| 11 | — | ○ | ○ | ○ |
| 12 | — | ○ | ○ | ○ |
| 13 | — | ○ | ○ | ○ |
| 14 | — | ○ | ○ | ○ |
| 15 | — | ○ | X | X |
| 16 | — | ○ | X | ○ |
| 17 | — | ○ | X | ○ |
| 18 | — | ○ | ○ | ○ |
| 19 | — | X | ○ | ○ |
| 20 | — | ○ | ○ | ○ |
| 21 | Yes | ○○ | ○ | ○ |

| Sample | Conductivity: Resistance R mΩ | Conductivity: Grade | Overall Grade |
|---|---|---|---|
| 1 | 10 < R ≦ 20 | ○ | X |
| 2 | 1 < R ≦ 2 | ○ | X |
| 3 | 1 < R ≦ 2 | ○ | X |
| 4 | 3 < R ≦ 5 | ○ | ○ |
| 5 | 5 < R ≦ 8 | ○ | ○ |
| 6 | 10 < R ≦ 20 | ○ | ○ |
| 7 | 2 < R ≦ 3 | ○ | X |
| 8 | 5 < R ≦ 8 | ○ | ○ |
| 9 | 10 < R ≦ 20 | ○ | ○ |
| 10 | 20 < R ≦ 50 | ○ | ○ |
| 11 | 100 < R ≦ 200 | X | X |
| 12 | 8 < R ≦ 15 | ○ | ○ |
| 13 | 25 < R ≦ 60 | ○ | ○ |
| 14 | 15 < R ≦ 30 | ○ | ○ |
| 15 | 15 < R ≦ 30 | ○ | X |
| 16 | 20 < R ≦ 50 | ○ | X |
| 17 | 50 < R ≦ 100 | ○ | X |
| 18 | 2 < R ≦ 3 | ○ | ○ |
| 19 | 2 < R ≦ 3 | ○ | ○ |
| 20 | 5 < R ≦ 8 | ○ | ○ |
| 21 | 10 < R ≦ 20 | ○ | ○ |

As a result of the evaluation test of gas-tightness, the first and nineteenth samples were graded "X", and all the second, eighteenth and twentieth samples were graded "o". In the first sample, the contents of the metallic component in the center electrode side sealing member was 75 wt. %, and the sealing members of all the second to seventeenth samples of the same glass component composition had a metallic component content of 70 wt. % or less. Based thereon, the viscosity was found to rise when the content of the metallic component of the respective sealing members was larger than 70 wt. %, and the fluidity of the sealing members at the heating step (glass, sealing step) decreased to the extent that they did not smoothly proceed into the clearance between the trailing end portion of the center electrode and the axial hole. The drape between the sealing members and the insulator was also found to be poor in that the glass component content relatively decreased as the metallic component content of the sealing members increased. As a result, the sealing members could not be sufficiently fixed to the axial hole, to thereby make it difficult to retain gas tightness.

On the other hand, the nineteenth sample had a metallic component content of 58 wt. %, and its testing conditions excepting the difference in the composition of the glass component were identical to those of the eighteenth sample. In the nineteenth sample, the B content of the glass component in the center electrode side sealing member in terms of $B_2O_3$ was higher than that of the seventh and eighteenth samples, and the thermal expansion coefficient was larger. Since the center electrode side sealing member was arranged closer to the combustion chamber than the connecting terminal side sealing member, it was found that separations or cracks might be caused if the sealing member employed the borosilicate glass Y as the glass component between the sealing member and the insulator. This was due to heat generation while the engine was running, such that it was difficult to retain gas-tightness. In comparing the eighteenth sample with the seventh sample, no problem arose in gas-tightness even when the borosilicate glass Y was employed as the glass component, if the connecting terminal side sealing member was arranged at a position farther from the combustion chamber than the center electrode side sealing member. The results of these evaluation tests show that the content WB1 (B content in terms of $B_2O_3$) in the glass component of the sealing member 80 is desirably the same or less than the content WB2 (B content in terms of $B_2O_3$) in the glass component of the sealing member 85.

Next, the evaluation tests of shock resistance on the center electrode side sealing member revealed that the center electrode was loosened in the fifteenth to seventeenth samples. In the fifteenth to seventeenth samples, the content of the metallic component in the center electrode side sealing member was 37 wt. %. In the remaining samples, the content of the metallic component in the center electrode sealing member was 53 wt. %. Generally, the trailing end portion of the center electrode 20 is not knurled. Further, the drape of the sealing member to the surface of the trailing end portion 24 of the center electrode 20 becomes hard when the content of the metallic component in the center electrode sealing member is less than 53 wt. %, to thereby result in insufficient fixture. It was also found that the sealing member could not withstand shocks accompanying the engine vibrations transmitted through the center electrode because of the increased glass component, to thereby result in insufficient fixture of the center electrode.

As a result of the evaluation tests of the shock-resistance on the connecting terminal side sealing member, the connecting terminal became loose in the second, third, seventh and fifteenth samples. The metallic component content in the connecting terminal side sealing member was 58 wt. % or more in those individual samples which exhibited a loose condition, and the content of the metallic component in the connecting terminal side sealing member was 52 wt. % in the remaining samples. It was found that sufficiently high fluidity at the sealing member heating step was desired so that the sealing member might proceed (i.e., flow) into the clearance between the knurled leading end portion 41 of the connecting terminal 40 and the axial hole 12, and that the content of the metallic component is desirably 52 wt. % or less for providing sufficiently high fluidity. Even when the content of the metallic component in the connecting terminal side sealing member was less than that of the metallic component in the center electrode side sealing member, sufficient fixture could be achieved because the leading end portion of the connecting terminal was knurled.

In the eighth sample, as compared with the twentieth sample, the borosilicate glass X was employed as the glass component of the center electrode side sealing member, whereas the borosilicate glass Y was employed in the twentieth sample, but the connecting terminals of the two samples did not become loose. As described above, the borosilicate glass Y has a lower softening point, that is, it is softer than the borosilicate glass X and therefore has superior fluidity. At the heating step, therefore, the sealing member can proceed more smoothly into the clearance between the leading end portion 41 of the connecting terminal 40 and the axial hole 12. Therefore, comparisons were made between the seventh sample, in which the connecting terminal side sealing member had a metallic component content as high as 58 wt. % so that the connecting terminal became loose, and the eighteenth sample, in which the borosilicate glass Y was used as the glass component of the connecting terminal side sealing member. The connecting terminal exhibited improved fixture. Based thereon, it was found that the connecting terminal 40 and the axial hole 12 could be sufficiently fixed by causing the sealing member to proceed into the clearance between the leading end portion 41 of the connecting terminal 40 and the axial hole 12 to thereby enhance the shock resistance of the connecting terminal, as long as fluidity at the heating step can be kept high enough even when the sealing member has a high metallic component content.

As a result of the evaluation tests on the conductivities of the center electrode and the connecting terminal, the resistance R of the eleventh sample was higher than 100 mΩ and lower than 200 mΩ (poor conductivity). In the first to tenth samples and in the twelfth to twentieth samples, the resistance R was 100 mΩ or less. Since the conductivity of the sealing member is a function of the metallic component diffusing into the glass component, it was found that the eleventh sample had an increased electrical resistance because the content of the metallic component of the connecting terminal side sealing member was as small as 25 wt. %.

Moreover, an overall evaluation of "X" was given in case any of the evaluation tests of gas-tightness, shock resistance and electric resistance for a given sample were graded "X", and an overall evaluation of "o" was given in the case that all of the evaluation tests were graded "o". As a result, the overall evaluations of the first to third samples, the seventh sample, the eleventh sample, the fifteenth to seventeenth samples and the nineteenth sample were "X", and the overall evaluations of the fourth to sixth samples, the eighth to tenth samples, the twelfth to fourteenth samples, the eighteenth sample and the twentieth sample were "○".

The invention is not intended to be limited to the foregoing embodiment, but can be modified in various ways. For example, a third sealing member (or a third sealing layer) containing a filler having a low expansion coefficient may be arranged between the sealing member 80 on the side of the center electrode 20 and the sealing member 85 on the side of the connecting terminal 40. The filler is desirably made from an inorganic material of an oxide group having a lower thermal expansion coefficient than that of the glass component and can be selected from one or two or more kinds of β-eucryptite, β-spodumene, keatite, silica, mullite, cordierite, zircon and aluminum titanate. The filler made from such inorganic material of an oxide group has such a high affinity with the glass component so as to realize a sealing structure having excellent shock resistance and gas-tightness.

A twenty first sample was prepared by sandwiching a third layer containing 12.6 wt. % of the aforementioned low expansion filler, 29.4 wt. % of the glass component and 58 wt. % of the metallic component between the center electrode side sealing member and the connecting terminal side sealing member. This sample was subjected to the evaluations described in Example 1. The metallic component content of the center electrode side sealing member was 58 wt. %, and the metallic component content of the connecting terminal side sealing member was 37 wt. %. The borosilicate glass X was used as the glass component of each sealing member, and Cu—Zn was used as the metallic component. The results of the evaluation tests on shock resistance of the twenty-first sample were similar to those of the ninth sample so that neither the center electrode nor the connecting terminal became loose. The results of the evaluation tests on conductivity were similar to those of the ninth sample and exhibited sufficient conductivity. The results of the evaluation tests on the gas-tightness are usually conducted by applying an air pressure of 1.5 MPa, but no air leakage occurred even when an air pressure of 3 MPa was applied, so that the samples were graded "oo" because the gas-tightness was judged very high. Thus, the gas-tightness of the axial hole of the insulator could be improved by sandwiching the third sealing layer between the center electrode side sealing member and the connecting terminal side sealing member.

Alternatively, a resistor may be interposed between the sealing member 80 and the sealing member 85, or a resistance layer may also be interposed together with the third sealing layer containing the aforementioned low expansion filler. If the structure is made laminar so that the sealing member 80 contacts the center electrode 20 and the sealing member 85 contacts the connecting terminal 40, the layers between the sealing member 80 and the sealing member 85 may be formed of any number of layers. The resistors may be thus interposed, but the eleventh sample had an overall evaluation of "X". These evaluations are backed by the presence of an engine demanding a spark plug (generally called a "resistance-less spark plug") where less energy loss is more important than performance so as to reduce electric wave noise. In short, the spark plug of the invention can be properly applied to such an engine.

In the embodiment, moreover, a corrugated shape was formed in the outer circumference of the leading end portion 41 of the connecting terminal 40 by a knurling operation. However, the corrugated shape is not limited thereto but may be formed to have an external thread or a bellows. When the leading end portion 41 of the connecting terminal 40 having such corrugations is completely covered as in the invention with the sealing member 85 having a composition different from that of the sealing member 80, it is possible to realize a more desirable spark plug 100 from the viewpoint of improved gas-tightness and fixture.

The present invention can be applied to a spark plug, in which the axial hole of the insulator is filled with the sealing members for electrically connecting the center electrode and the connecting terminal.

This application is based on Japanese Patent Application JP 2004-381502, filed Dec. 28, 2004, the entire content of which is hereby incorporated by reference, the same as if set forth at length.

What is claimed is:

1. A spark plug comprising:

a cylindrical insulator having an axial hole extending in an axial direction;

a center electrode held in said axial hole on a leading end side;

a connecting terminal held in said axial hole on a trailing end side; and a sealing layer provided in said axial hole and comprising a glass sealing material containing a glass component and a metallic component, said sealing layer including a first sealing layer containing a first glass sealing material and a second sealing layer containing a second glass sealing material laminated in an axial direction of said axial hole, said first sealing layer contacting said center electrode, and said second sealing layer contacting said connecting terminal, wherein said second glass sealing material has higher fluidity than that of said first glass sealing material at a temperature higher than a softening point of a glass component contained in said sealing layer, and wherein a content of the metallic component in said first sealing layer is larger than a content of the metallic component in said second sealing layer.

2. The spark plug as claimed in claim 1, wherein said second sealing layer has a lower viscosity than that of said first sealing layer at a temperature higher than a softening point of a glass component contained in said sealing layer.

3. The spark plug as claimed in claim 1, wherein a glass component contained in said second sealing layer has lower softening point than that of a glass component contained in said first sealing layer.

4. The spark plug as claimed in claim 1, wherein a content of the metallic component in said first sealing layer is from 53 to 70 wt. %, and a content of the metallic component in said second sealing layer is from 30 to 52 wt. %.

5. The spark plug as claimed in claim 1, wherein said sealing layer further includes a third sealing layer which is provided between said first sealing layer and said second sealing layer and which contains a filler having a smaller coefficient of thermal expansion than the coefficient of thermal expansion of the glass component in said first sealing layer and the coefficient of thermal expansion of the glass component in said second sealing layer.

6. A spark plug comprising:

a cylindrical insulator having an axial hole extending in an axial direction;

a center electrode held in said axial hole on a leading end side;

a connecting terminal held in said axial hole on a trailing end side; and a sealing layer provided in said axial hole and comprising a glass sealing material containing a glass component and a metallic component, said sealing layer including a first sealing layer containing a first glass sealing material and a second sealing layer containing a second glass sealing material laminated in an axial direction of said axial hole, said first sealing layer contacting said center electrode, and said second sealing layer contacting said connecting terminal, wherein said second glass sealing material has higher fluidity than that of said first glass sealing material at a temperature higher than a softening point of a glass component contained in said sealing layer, wherein the glass component of said sealing layer contains Si, B and an alkali metal comprising at least one of K and Na, a content of one of Si and B in said sealing layer is larger than that of any other glass component in said sealing layer, and a content of the other of Si and B in said sealing layer is not larger than the content of said one of Si and B and is larger than that of any other glass component in said sealing layer, and said sealing layer satisfies either of the following relationships:

WB1<WB2, and WA1≦WA2; or

WB1≦WB2, and WA1<WA2, wherein WB1 represents a content of B in said first sealing layer in terms of $B_2O_3$, WB2 represents a content of B in said second sealing layer in terms of $B_2O_3$, WA1 represents a content of A in said first sealing layer in terms of $A_2O$, and WA2 represents a content of A in said second sealing layer in terms of $A_2O$ where A represents the alkali metal.

7. The spark plug as claimed in claim 6, wherein a content of B in said sealing layer in terms of $B_2O_3$ is from 22 to 45 wt. %.

8. The spark plug as claimed in claim 6, wherein a content of the alkali metal A in said sealing layer in terms of $A_2O$ is from 4 to 15 wt. %.

9. The spark plug as claimed in claim 6, wherein the glass component in said first sealing layer contains:

from 55 to 65 wt. % of Si in terms of $SiO_2$;

from 22 to 35 wt. % of B in terms of $B_2O_3$;

from 0.2 to 2 wt. % of Ca in terms of CaO;

2 wt. % or less of Al in terms of $Al_2O_3$; and from 4 to 8 wt. % of at least one of Na and K in terms of $Na_2O$ and $K_2O$, respectively, and the glass component in said second sealing layer contains one of following compositions (1) to (3):

(1) from 45 to 50 wt. % of Si in terms of $SiO_2$; from 35 to 45 wt. % of B in terms of $B_2O_3$; from 0.2 to 2 wt. % of Ca in terms of CaO; 2 wt. % or less of Al in terms of $Al_2O_3$; and from 4 to 8 wt. % of at least one of Na and K in terms of $Na_2O$ and $K_2O$, respectively, (2) from 55 to 65 wt. % of Si in terms of $SiO_2$; from 22 to 35 wt. % of B in terms of $B_2O_3$; from 0.2 to 2 wt. % of Ca in terms of CaO; 2 wt. % or less of Al in terms of $Al_2O_3$; and from 8 to 15 wt. % of at least one of Na, K and Li in terms of $Na_2O$, $K_2O$ and $Li_2O$ respectively, and (3) from 45 to 50 wt. % of Si in terms of $SiO_2$; from 35 to 45 wt. % of B in terms of $B_2O_3$; from 0.2 to 2 wt. % of Ca in terms of CaO; 2 wt. % or less of Al in terms of $Al_2O_3$; and from 8 to 15 wt. % of at least one of Na, K and Li in terms of $Na_2O$, $K_2O$ and $Li_2O$ respectively.

* * * * *